US008577247B2

(12) United States Patent
Kimura et al.

(10) Patent No.: US 8,577,247 B2
(45) Date of Patent: Nov. 5, 2013

(54) DISCHARGER AND IMAGE FORMING APPARATUS HAVING AN ELECTRODE CLEANING DETECTION MEMBER

(75) Inventors: Akiko Kimura, Kanagawa (JP); Kanji Watanabe, Kanagawa (JP); Yuzo Ichikawa, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 13/152,078

(22) Filed: Jun. 2, 2011

(65) Prior Publication Data

US 2012/0163854 A1 Jun. 28, 2012

(30) Foreign Application Priority Data

Dec. 27, 2010 (JP) ..... 2010-291159

(51) Int. Cl.
*G03G 15/02* (2006.01)
*G03G 21/18* (2006.01)

(52) U.S. Cl.
USPC ..... 399/100; 399/115

(58) Field of Classification Search
USPC ..... 399/100, 170, 171, 172, 115
See application file for complete search history.

(56) References Cited

U.S. PATENT DOCUMENTS

| | | | | |
|---|---|---|---|---|
| 6,163,664 | A | 12/2000 | Hayashi | |
| 7,769,313 | B2 | 8/2010 | Matsuyama et al. | |
| 7,835,667 | B2 | 11/2010 | Ohno et al. | |
| 2005/0063727 | A1 * | 3/2005 | Quinones | 399/100 |
| 2008/0019728 | A1 | 1/2008 | Matsuyama et al. | |
| 2008/0226334 | A1 | 9/2008 | Ohno et al. | |
| 2010/0104317 | A1 * | 4/2010 | Tanase | 399/100 |

FOREIGN PATENT DOCUMENTS

| | | | |
|---|---|---|---|
| JP | 11-242374 | A | 9/1999 |
| JP | 2003-091145 | A | 3/2003 |
| JP | 2003-202734 | A | 7/2003 |
| JP | 2006-091456 | A | 4/2006 |
| JP | 2008-026646 | A | 2/2008 |
| JP | 2008-233254 | A | 10/2008 |

* cited by examiner

*Primary Examiner* — Billy J Lactaoen
(74) *Attorney, Agent, or Firm* — Sughrue Mion, PLLC

(57) ABSTRACT

A discharger includes a discharger main body that is adapted to be attached to and detached from a holding member of an image forming apparatus, a first electrode member that is formed of a wire rod, a second electrode member, a voltage for discharge being applied between the first and second electrode members, an electrode cleaning member that cleans the first electrode member, a detected portion that is integrally disposed to the electrode cleaning member, a detecting member that detects the detected portion while the electrode cleaning member is in a predetermined reference position, a cleaning member conveyer that conveys the electrode cleaning member in both directions which toward and away from the reference position, and a movement control unit that controls a movement of the cleaning member conveyer by the conveyer.

8 Claims, 10 Drawing Sheets

REFERENCE POSITION RETURN PROCESSING OF ELECTRODE CLEANER

DISCHARGER AND IMAGE FORMING APPARATUS HAVING AN ELECTRODE CLEANING DETECTION MEMBER

CROSS-REFERENCE TO RELATED APPLICATION

This application is based on and claims priority under 35 USC 119 from Japanese Patent Application No. 2010-291159 filed on Dec. 27, 2010.

BACKGROUND

1. Technical Field

The present invention relates to a discharger and an image forming apparatus.

2. Related Art

In an electrophotographic image forming apparatus in the related art, a discharger, which performs discharge from an electrode, such as a corotron or a scorotron, has been widely used to charge the surface of an image carrier, to eliminate electric charges on the surface of the image carrier, to transfer a toner image formed on the surface of an image carrier to a medium, or to eliminate electric charges on a medium.

SUMMARY

According to an aspect of the invention, there is provided a discharger including:

a discharger main body that is disposed so as to face a discharged portion of an image forming apparatus and is adapted to be attached to and detached from a holding member of the image forming apparatus body;

a first electrode member that is supported by the discharger main body and is formed of a wire rod;

a second electrode member that is disposed so as to face the first electrode member, a voltage for discharge being applied between the first and second electrode members;

an electrode cleaning member that contacts with and cleans the first electrode member;

a detected portion that is integrally disposed to the electrode cleaning member;

a detecting member that detects the detected portion while the electrode cleaning member is in a predetermined reference position;

a cleaning member conveyer that conveys the electrode cleaning member along the first electrode member in both directions which toward and away from the reference position; and a movement control unit that controls a movement of the cleaning member conveyer by the conveyer, wherein the movement control unit control the conveyer to move the electrode cleaning member to be away from the reference position when the discharger main body is mounted on the holding member until the detecting member does not detect the detected portion, and then controls the conveyer to move the electrode cleaning member toward the reference position.

BRIEF DESCRIPTION OF THE DRAWINGS

Exemplary embodiments of the present invention will be described in detail based on the following figures, wherein.

DETAILED DESCRIPTION

Figure 1:
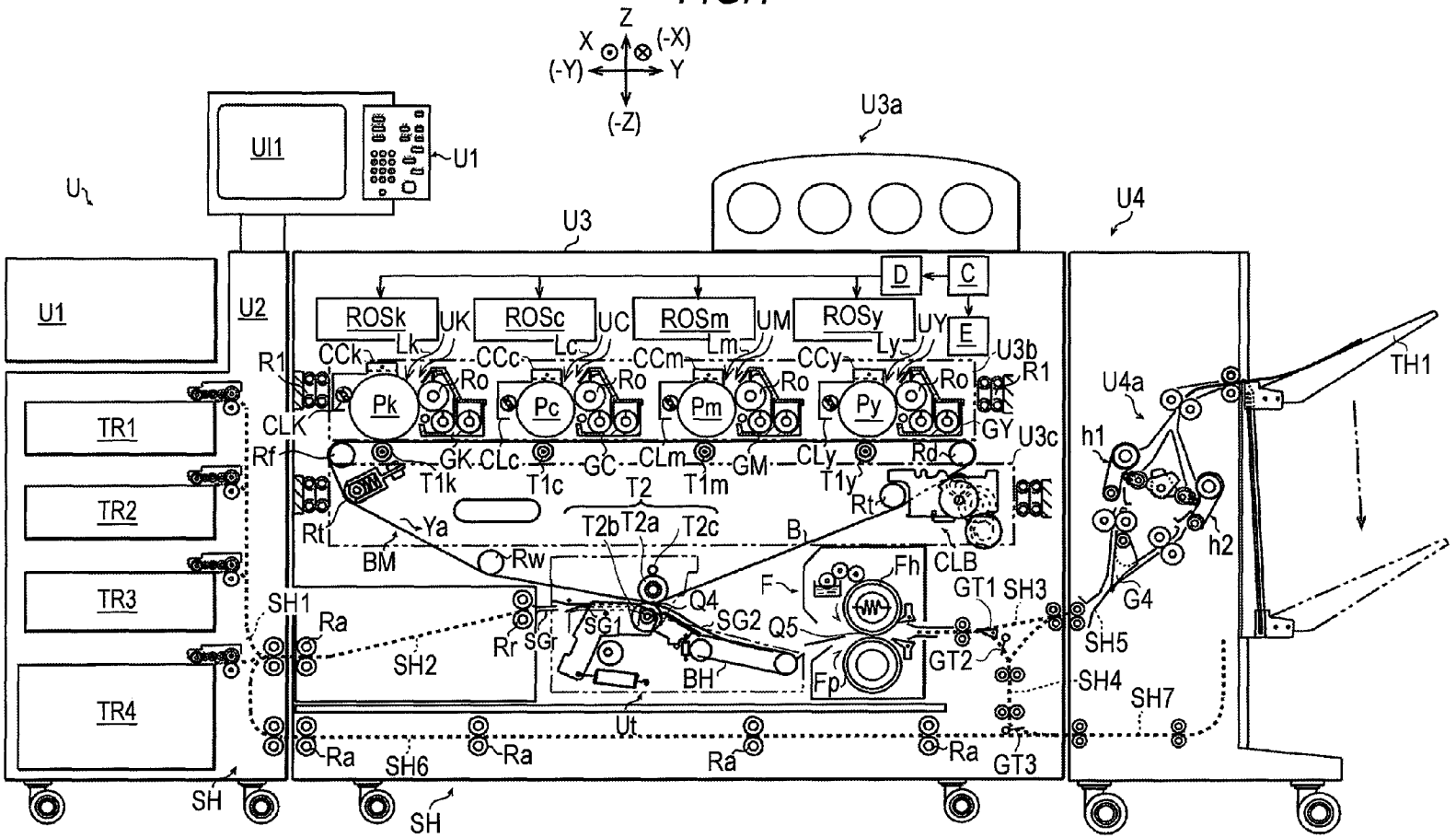
FIG. 1 is a view showing the entire configuration of an image forming apparatus according to a first example of the invention.

A specific example (hereinafter, referred to as an example) of an exemplary embodiment of the invention will be described below with reference to the drawings, but the invention is not limited to the following example.

Meanwhile, in order to facilitate the understanding of the following description, in the drawings, the front-and-rear direction is defined as the X-axis direction, the left-and-right direction is defined as the Y-axis direction, and the up-and-down direction is defined as the Z-axis direction. Further, directions or sides indicated by arrows X, −X, Y, −Y, Z, and −Z are defined as the front direction, the rear direction, the right direction, the left direction, the upward direction, and the downward direction, or are defined as the front side, the rear side, the right side, the left side, the upper side, and the lower side, respectively.

Furthermore, in the drawings, an "O" symbol with a "●" therein means an arrow that is directed to the front of a sheet from the back thereof, and an "O" symbol with an "X" therein means an arrow that is directed to the back of the sheet from the front thereof.

Meanwhile, other members except for members, which are required for the description, are appropriately omitted in the description using the following drawings in order to facilitate the understanding of the following description.

First Example

FIG. 1 is a view showing the entire configuration of an image forming apparatus according to a first example of the invention.

In FIG. 1, an image forming apparatus U includes a user interface UI serving as an example of an operation section, an image input device U1 as an image reading section, a sheet feed device U2, an image recording device U3 that is an example of a main body of the image forming apparatus and serves as an example of an attachment/detachment target body, and a sheet processing device U4.

The user interface UI includes a copy start key serving as an example of an input section, input keys such as ten keys, and a display portion UI1.

The image input device U1 is formed of an image scanner or the like serving as an example of an image reading device. In FIG. 1, the image input device U1 reads out a document (not shown), converts the read image into image information, and inputs the image information to the image recording device U3.

The sheet feed device U2 includes sheet feed trays TR1 to TR4 as plural sheet feed sections, sheet feed paths SH1 through which recording sheets S serving as examples of media received in the respective sheet feed trays TR1 to TR4 are conveyed, and the like.

In FIG. 1, the image recording device U3 includes an image recording section that records an image on the recording sheet S conveyed from the sheet feed device U2, a toner dispenser device U3*a*, a sheet conveying path SH2, a sheet ejection path SH3, a sheet reversing path SH4, a sheet circulating path SH6, and the like. Meanwhile, the image recording section will be described below.

Further, the image recording device U3 includes a controller C, a laser driving circuit D that serves as an example of a driving circuit of a latent image writing device controlled by the controller C, a power circuit E that is controlled by the controller C, and the like. The laser driving circuit D, of which the operation is controlled by the controller C, outputs laser drive signals, which correspond to Y (yellow), M (magenta), C (cyan), and K (black) image information input from the image input device U1, to latent image forming devices ROSy, ROSm, ROSc, and ROSk, which correspond to the respective colors, at a predetermined time, respectively.

A pull-out member U3*b* for image forming units is supported below the latent image forming devices ROSy, ROSm, ROSc, and ROSk, which correspond to the respective colors, by a pair of (left and right) guide members R1 and R1 so as to be capable of moving between a pull-out position where the pull-out member U3*b* is pulled out to the front side of the image recording device U3 and a loading position where the pull-out member U3*b* is loaded in the image recording device U3.

Figure 2:
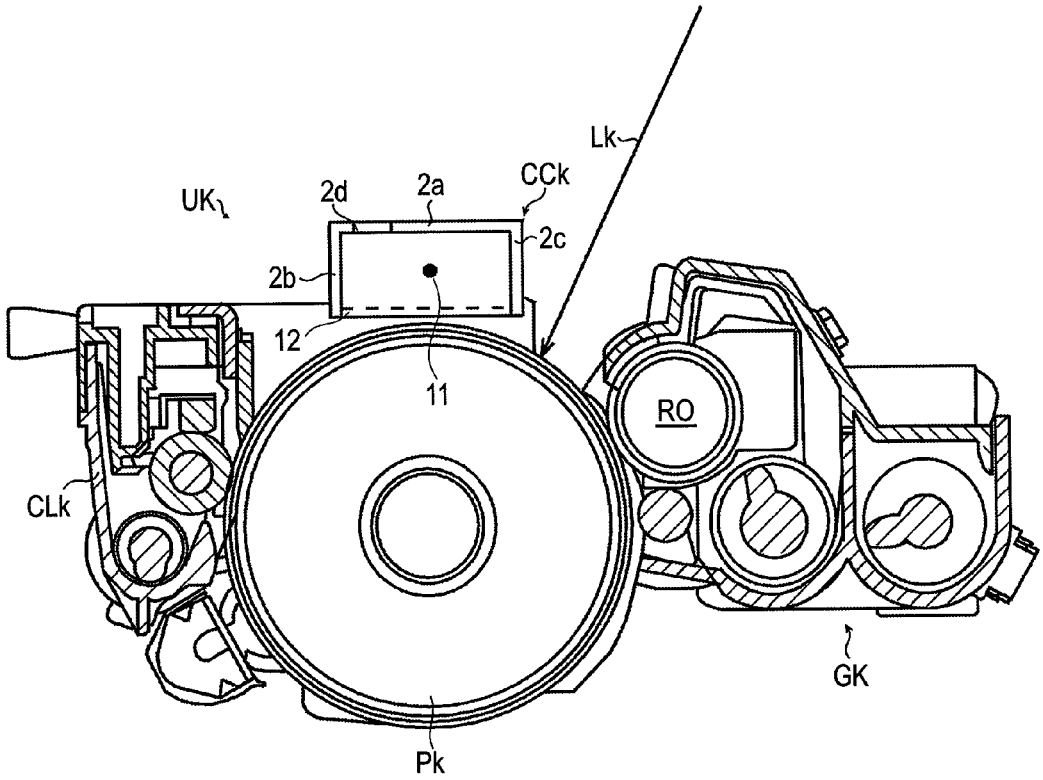
FIG. 2 is a view showing a visible image forming device that includes an image carrier unit and a developing unit.

FIG. 2 is a view showing a visible image forming device that includes an image carrier unit and a developing unit.

In FIGS. 1 and 2, a black image carrier unit UK includes a photoconductor Pk that is an example of an image carrier and serves an example of a discharge target body, a charger CCk serving as an example of a discharger, and a photoconductor cleaner CLk that serves as an example of a cleaner for the image carrier. Meanwhile, in the first example, the charger CCk is formed of a charging unit that can be attached to and detached from the image recording device U3. Further, the image carrier units UY, UM, and UC, which correspond to the other colors Y, M, and C, include photoconductors Py, Pm, and Pc, chargers CCy, CCm, and CCc serving as examples of dischargers, and photoconductor cleaners CLy, CLm, and CLc, respectively. Meanwhile, in the first example, the black photoconductor Pk, which is frequently used and of which the surface is greatly worn down, is formed to have a diameter larger than the diameter of each of other color photoconductors Py, Pm, and Pc. Accordingly, it may be possible to cope with the high speed rotation of the black photoconductor and to lengthen the life of the black photoconductor.

Toner image forming members UY+GY, UM+GM, UC+GC, and UK+GK are formed of the respective image carrier units UY, UM, UC, and UK and developing units GY, GM, GC, and GK including developing rollers R0. The image carrier units UY, UM, UC, and UK and the developing units GY, GM, GC, and GK are detachably mounted on the pull-out member U3*b* for image forming units.

In FIG. 1, after the photoconductors Py, Pm, Pc, and Pk are charged by the chargers CCy, CCm, CCc, and CCk, respectively, electrostatic latent images are formed on the surfaces of the photoconductors by laser beams Ly, Lm, Lc, and Lk serving as an example of latent image writing light output from the latent image forming devices ROSy, ROSm, ROSc, and ROSk. The electrostatic latent images, which are formed on the surfaces of the photoconductors Py, Pm, Pc, and Pk, are developed into Y (yellow), M (magenta), C (cyan), and K (black) toner images by the developing units GY, GM, GC, and GK.

The toner images, which are formed on the surfaces of the photoconductors Py, Pm, Pc, and Pk, are sequentially superimposed and transferred to an intermediate transfer belt B, which is an example of an image carrier and serves as an example of an intermediate transfer body, by primary transfer rollers T1*y*, T1*m*, T1*c*, and T1*k* that serve as examples of primary transfer sections. Accordingly, a polychrome image, that is, a so-called color image is formed on the intermediate transfer belt B. The color image, which is formed on the intermediate transfer belt B, is conveyed to a secondary transfer area Q4 serving as an example of an image recording position.

Meanwhile, when only black image data exist, only the K (black) photoconductor Pk and the K (black) developing unit GK are used, so that only a black toner image is formed.

After primary transfer, residual toner, which remains on the surfaces of the photoconductors Py, Pm, Pc, and Pk, is removed by cleaners CLy, CLm, CLc, and CLk for the photoconductors.

A pull-out member U3*c* for the intermediate transfer body is supported below the pull-out member U3*b* for the image forming units so as to be capable of moving between a pull-out position where the pull-out member is pulled out to the front side of the image recording device U3 and a loading position where the pull-out member is loaded in the image recording device U3. A belt module BM serving as an example of an intermediate transfer device is supported by a pull-out member U3*c* for the intermediate transfer body so as to be capable of moving up and down between an elevated position where the belt module comes into contact with the lower surfaces of the photoconductors Py, Pm, Pc, and Pk and a lowered position where the belt module is separated downward from the lower surfaces.

The belt module BM includes the intermediate transfer belt B, belt support rollers Rd, Rt, Rw, Rf, and T2*a* serving as examples of intermediate transfer body supporting members, and the primary transfer rollers T1*y*, T1*m*, T1*c*, and T1*k*. The belt support rollers Rd, Rt, Rw, Rf, and T2*a* include a belt drive roller Rd serving as an example of a driving member, a tension roller Rt serving as an example of a tension applying member, a walking roller Rw serving as an example of a meandering prevention member, plural idler rollers Rf serving as examples of driven members, and a back-up roller T2*a* serving as an example of a member facing the secondary transfer area Q4. Further, the intermediate transfer belt B is supported by the belt support rollers Rd, Rt, Rw, Rf, and T2*a* so as to be capable of rotating in the direction of an arrow Ya.

A secondary transfer unit Ut is disposed below the back-up roller T2*a*. The secondary transfer unit Ut includes a secondary transfer roller T2*b* serving as an example of a secondary transfer member. The secondary transfer roller T2*b* is disposed so as to be capable of being separated from and coming into contact with the back-up roller T2*a* with the intermediate transfer belt B interposed between itself and the back-up roller, and an area where the secondary transfer roller T2*b* comes into contact with the intermediate transfer belt B forms the secondary transfer area Q4. Further, a contact roller T2*c*, which serves as an example of a contact member applying a voltage, comes into contact with the back-up roller T2*a*, and the respective rollers T2*a* to T2*c* form a secondary transfer section T2.

A secondary transfer voltage, which has the same polarity as the polarity of charged toner, is applied to the contact roller T2*c* from a power circuit, which is controlled by the controller C, at a predetermined time.

The sheet conveying path SH2 is provided below the belt module BM. Recording sheets S, which are fed from the sheet feed paths SH1 of the sheet feed device U2, are conveyed to the sheet conveying path SH2, and are conveyed to the secondary transfer area Q4 through medium guide members SGr and SG1 before transfer in accordance with the time in which the toner images are conveyed to the secondary transfer area Q4, by a registration roller Rr serving as an example of a member that adjusts a sheet feeding time.

The toner images, which are formed on the intermediate transfer belt B, are transferred to the recording sheet S by the secondary transfer section T2 when passing through the secondary transfer area Q4. Meanwhile, in the case of a full-color image, the toner images, which are superimposed on the surface of the intermediate transfer belt B and are primarily transferred, are collectively and secondarily transferred to the recording sheet S.

The intermediate transfer belt B, which has been subjected to secondary transfer, is cleaned by a belt cleaner CLB that serves as an example of a cleaner for the intermediate transfer body.

The primary transfer rollers T1*y*, T1*m*, T1*c*, and T1*k*, the intermediate transfer belt B, the secondary transfer section T2, the belt cleaner CLB, and the like form a transfer device T1+B+T2+CLB that transfers the images formed on the surfaces of the photoconductors Py to Pk to the recording sheet S.

The recording sheet S to which the toner images have been transferred is conveyed to a fixing device F through a medium guide member SG2 after transfer and a sheet conveying belt BH that serves as an example of a medium conveying member before fixing. The fixing device F includes a heating roller Fh serving as an example of a heating-fixing member and a pressing roller Fp serving as an example of a pressing-fixing member, and an area where the heating roller Fh and the pressing roller Fp come into contact with each other forms a fixing area Q5.

The toner images, which are transferred to the recording sheet S, are heated and fixed to the recording sheet by the fixing device F when passing through the fixing area Q5.

The toner image forming members UY+GY, UM+GM, UC+GC, and UK+GK, the transfer device T1+B+T2+CLB, the fixing device, and the like form the image recording section of the first example that records images on the recording sheet S.

A first gate GT1 serving as an example of a member, which switches a conveying path, is provided on the downstream side of the fixing device F. The first gate GT1 selectively switches the path of the recording sheet S, which is conveyed along the sheet conveying path SH2 and to which the toner images are heated and fixed at the fixing area Q5, to any one of a sheet reversing path SH4 or a sheet ejection path SH3 of the sheet processing device U4. The sheet S, which is conveyed along the sheet ejection path SH3, is conveyed to a sheet conveying path SH5 of the sheet processing device U4.

A curl correcting unit U4*a* serving as an example of a curvature correcting unit is disposed on the sheet conveying path SH5, and a second gate G4 serving as an example of a member, which switches a conveying path, is disposed on the sheet conveying path SH5. The second gate G4 conveys the recording sheet S, which is conveyed from the sheet conveying path SH3 of the image recording device U3, to any one of a first curl correcting member h1 and a second curl correcting member h2 according to the direction of curvature, that is, the curl. When the recording sheet S, which is conveyed to the first curl correcting member h1 or the second curl correcting member h2, passes through the first or second curl correcting member, the curl of the recording sheet is corrected. The recording sheet S of which the curl has been corrected is ejected to an ejection tray TH1, which serves as an example of an ejection section of the sheet processing device U4, from an ejection roller Rh, which serves as an example of an ejection member, in a state where an image fixing surface of the sheet faces upward, that is, in a so-called face-up state.

The sheet S, which is conveyed to the sheet reversing path SH4 of the image recording device U3 by the first gate GT1, passes through a member, which is formed of an elastic thin film-like member and regulates the conveying direction, that is, a so-called mylar gate GT2 while pushing the mylar gate GT2. Then, the sheet is conveyed to the sheet reversing path SH4 of the image recording device U3.

A sheet circulating path SH6 and a sheet reversing path SH7 are connected to the downstream end of the sheet reversing path SH4 of the image recording device U3, and a mylar gate GT3 is also disposed at a connection portion of the paths. The sheet, which is conveyed to the sheet conveying path SH4 through the first gate GT1, passes through the mylar gate GT3 and is conveyed to the sheet reversing path SH7 of the sheet processing device U4. When double-sided printing is to be performed, the recording sheet S conveyed to the sheet reversing path SH4 passes through the mylar gate GT3 and is conveyed to the sheet reversing path SH7. Then, when the recording sheet is conveyed in a reverse direction, that is, so-called switch-back of the recording sheet is performed, the conveying direction of the recording sheet is regulated by the mylar gate GT3 and the recording sheet S having been switched back is conveyed to the sheet circulating path SH6. The recording sheet S conveyed to the sheet circulating path SH6 is conveyed again to the secondary transfer area Q4 through the sheet feed path SH1.

Meanwhile, when the recording sheet S, which is conveyed along the sheet reversing path SH4, is switched back before the rear end of the recording sheet S passes through the mylar gate GT3 after passing through the mylar gate GT2, the conveying direction of the recording sheet S is regulated by the mylar gate GT2 and the recording sheet S is conveyed to the sheet conveying path SH5 while the surface and back surface of the recording sheet S are reversed. After the curl of the recording sheet S of which the surface and back surface have been reversed is corrected by the curl correcting member U4*a*, the recording sheet can be ejected to the sheet ejection tray TH1 of the sheet processing device U4 in a state where the image fixing surface of the sheet S faces downward, that is, in a so-called face-down state.

Elements, which are denoted by reference numerals SH1 to SH7, form a sheet conveying path SH. Further, elements, which are denoted by reference numerals SH, Ra, Rr, Rh, SGr, SG1, SG2, BH, and GT1 to GT3, form a sheet conveying device SU.

(Description of Charger)

Figure 3:
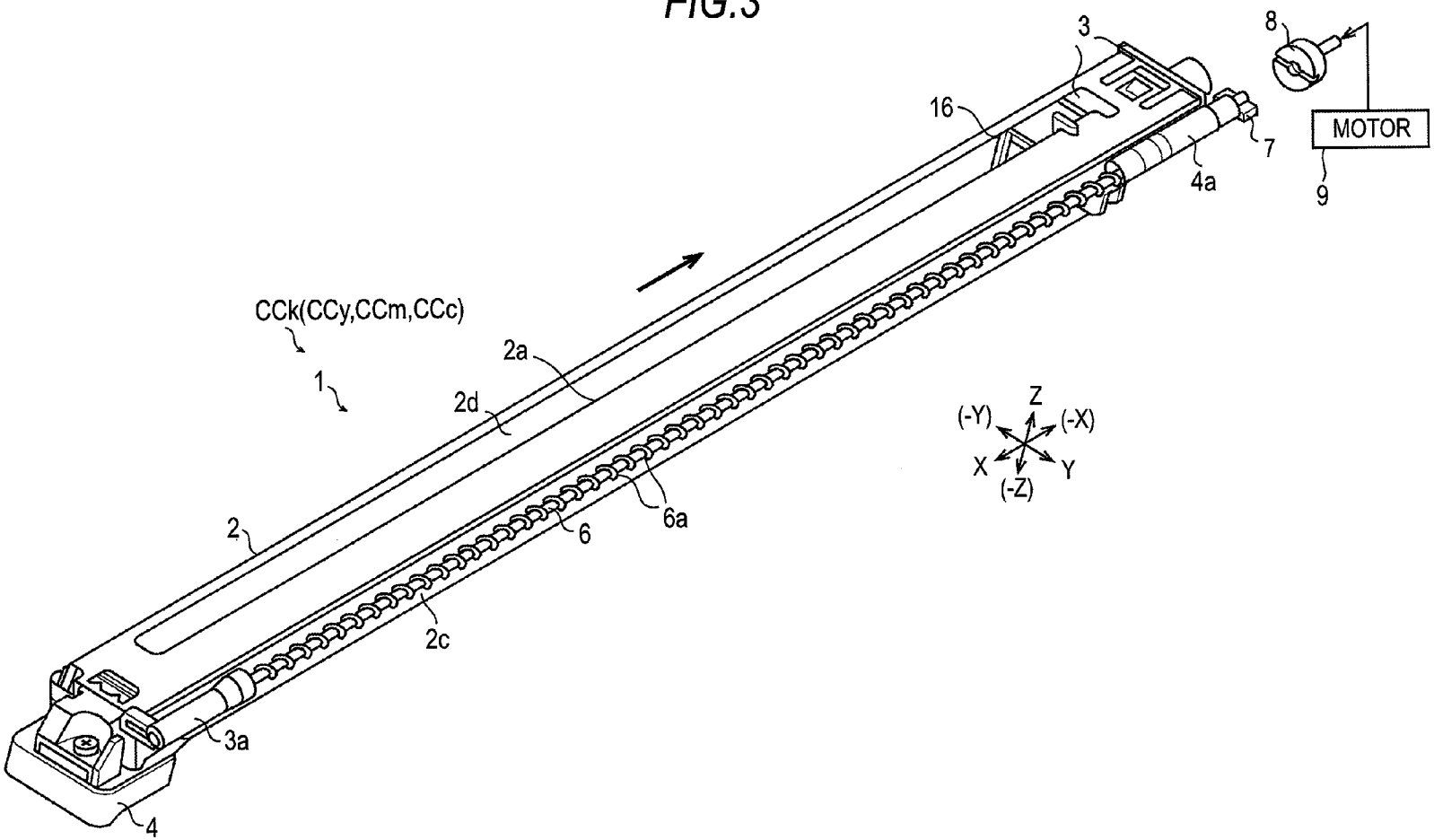
FIG. 3 is a perspective view of a charger of a first example of the invention.

FIG. 3 is a perspective view of the charger of the first example of the invention.

Figure 4:
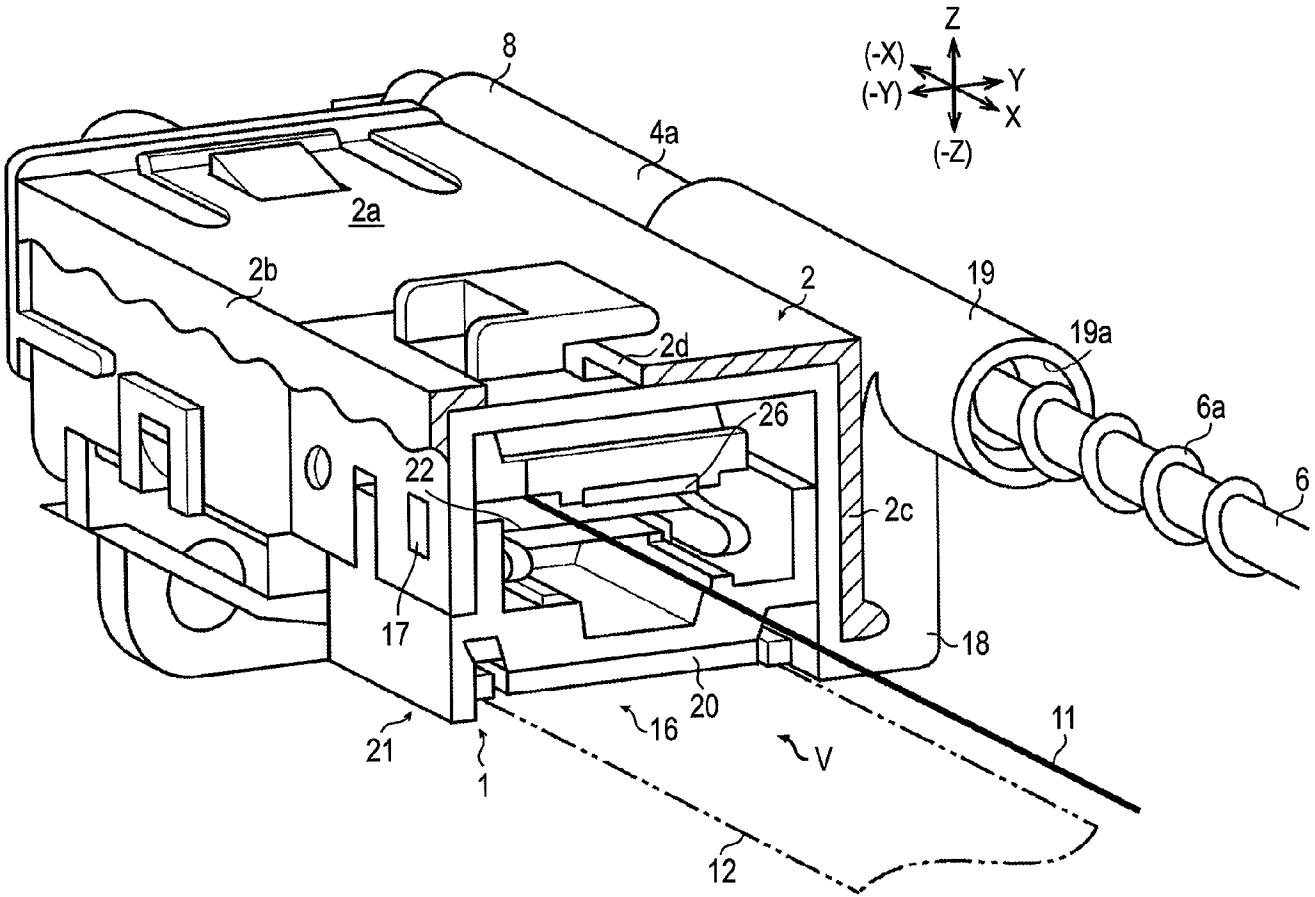
FIG. 4 is a view showing the cross-section of a main part of the charger of the first example of the invention.

FIG. 4 is a view showing the cross-section of a main part of the charger of the first example of the invention.

Figure 5:
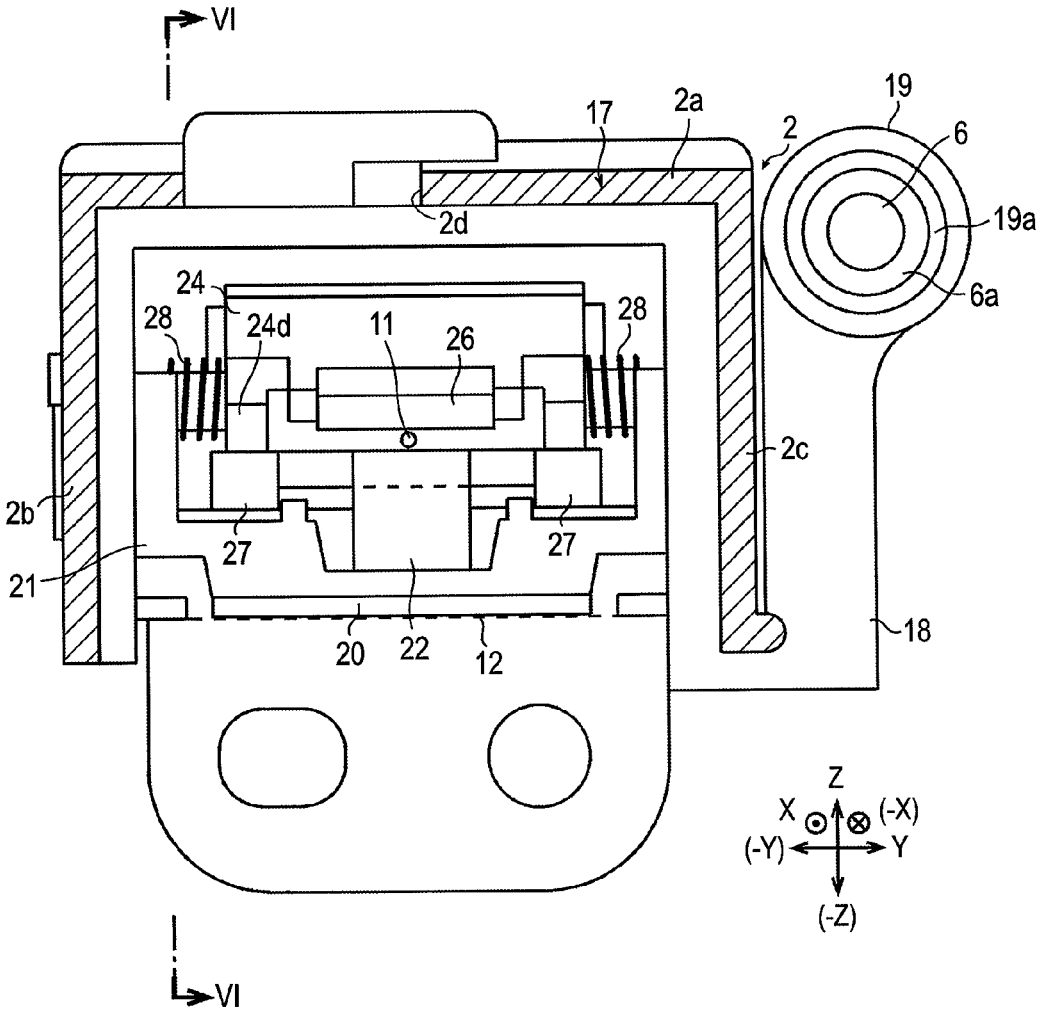
FIG. 5 is a view seen in the direction of an arrow V of FIG. 4.

FIG. 5 is a view seen in the direction of an arrow V of FIG. 4.

Figure 6:
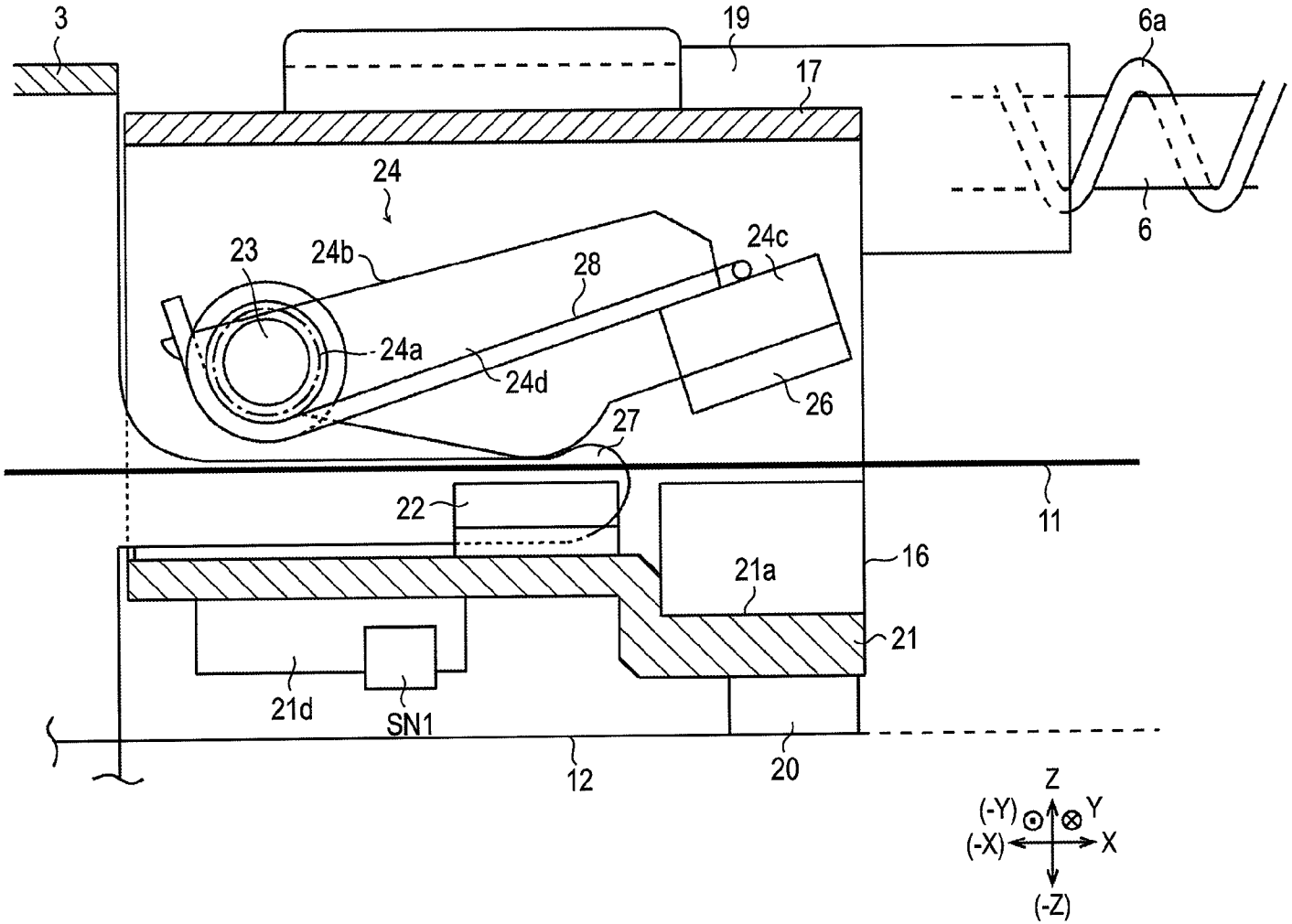
FIG. 6 is a cross-sectional view taken along a line VI-VI of FIG. 5, and is a view showing that an electrode cleaner is moved to a reference position.

FIG. 6 is a cross-sectional view taken along a line VI-VI of FIG. 5, and is a view showing that an electrode cleaner is moved to a reference position.

Meanwhile, in order to facilitate understanding of the invention, a part of a shield electrode is not shown in FIG. 4.

Further, the charger of the first example will be described next. However, since the chargers CCy to CCk corresponding to respective colors, that is, Y, M, C, and K have the same structure, the black charger CCk will be described in detail and the detailed description of other color chargers CCy to CCc will be omitted.

In FIGS. 2, 3, and 4, the charger CCk of the first example includes a charger main body 1 that is an example of a discharger main body and extends in a front-and-rear direction. The charger main body 1 includes a shield electrode 2. The shield electrode 2 is an example of a second electrode member, extends in the front-and-rear direction, and is formed of a U-shaped conductive metal material of which the side facing the photoconductor Pk is opened. The shield electrode 2 includes a plate-like upper wall portion 2*a* that extends in the front-and-rear direction, and plate-like left and right wall portions 2*b* and 2*c* that extend downward from both left and right ends of the upper wall portion 2*a*. An opening 2*d*, which extends in the front-and-rear direction, is formed at the left portion of the upper wall portion 2*a*, and air from an air blower (not shown), which is disposed in the image recording device U3, passes through the opening. Accordingly, it may be possible to discharge ozone and the like, which are generated at the time of discharge, through a charge area Q1 facing the photoconductor Pk.

A rear end block 3 serving as an example of a one end member is supported at the rear end of the shield electrode 2, and a front end block 4 serving as an example of the other end member is supported at the front end of the shield electrode 2. Cylindrical shaft receiving portions 3*a* and 4*a*, which extend in the front-and-rear direction, are formed at the upper right portions of the respective front and rear end blocks 3 and 4, as examples of supports for a cleaning member conveyer.

A shaft 6, which extends in the front-and-rear direction, is rotatably supported as an example of a rotating member by the shaft receiving portions 3*a* and 4*a*. A screw 6*a* is formed on the outer peripheral surface of the shaft 6. A rear end portion of the shaft 6 passes through the rear shaft receiving portion 3*a* and extends to the rear side, and a driven coupling 7 serving as an example of an engaging member is supported at the rear end of the shaft. When the charger CCk is mounted on the image recording device U3, the driven coupling 7 is supported while meshing with a driving coupling 8 serving as an example of a transmission member rotatably supported in the image recording device U3. Driving can be transmitted to the driving coupling 8 from an electrode cleaner motor 9, which can be driven in normal and reverse directions and supported as an example of a driving source of an electrode cleaning member by the image recording device U3.

In FIGS. 2 to 6, a wire electrode 11, which is formed of a wire rod extending in the front-and-rear direction and of which front and rear ends are supported by the respective front and rear end blocks 3 and 4, is disposed as an example of a first electrode member in the charger main body 1.

A net-shaped grid electrode 12, where plural through holes are formed at a thin film-like conductive material extending in the front-and-rear direction, is supported as an example of a third electrode member at an opening position below the shield electrode 2, that is, in the charge area Q1 that is an area facing the photoconductor Pk. The grid electrode 12 is supported while both the front and rear ends of the grid electrode 12 are stretched by the respective blocks 3 and 4.

A voltage for discharge is applied to each of the electrodes 2, 11, and 12 from the power circuit E, and the surface of the photoconductor Pk is charged by electrons that are discharged from the wire electrode 11 according to a potential difference between the wire electrode 11, the shield electrode 2, and the grid electrode 12.

Meanwhile, since the shield electrode 2, the wire electrode 11, and the grid electrode 12 have the structures well-known in the related art and may employ the structure disclosed in, for example, JP-A-2008-233254 and the like, the detailed description thereof will be omitted.

In FIGS. 4 to 6, an electrode cleaner 16 serving as an electrode cleaning body is disposed among the wire electrode 11, the shield electrode 2, and the grid electrode 12 in the charger main body 1. The electrode cleaner 16 includes a prismatic upper slider frame 17 that serves as an example of a first cleaning frame body. The prismatic upper slider frame 17 is made of an insulating material and is disposed along the inner peripheral surface of the shield electrode 2, and the lower side of the upper slider frame 17 is opened. An arm portion 18, which serves as an example of a connecting portion and is formed in a U shape so as to surround the lower end of a right wall portion 2*c* of the shield electrode 2, is formed at the lower right end of the upper slider frame 17. A cylindrical shaft-through portion 19, which serves as an example of an interlocking portion and through which the shaft 6 passes, is formed at the upper end of the arm portion 18. A screw 19*a*, which meshes with the screw 6*a* of the shaft 6, is formed in the shaft-through portion 19. Accordingly, when the shaft 6 is rotated in a normal or reverse direction, the arm portion 18 is moved along the shaft 6 in the front-and-rear direction by the screws 6*a* and 19*a*, that is, is moved forward so as to be separated from a rear home position serving as an example of a reference position or moved backward so as to approach the rear home position. As a result, the electrode cleaner 16 is moved in the front-and-rear direction.

The shaft 6, the arm portion 18, the shaft-through portion 19, and the like form a cleaning member conveyer 6+18+19 of the first example.

A U-shaped lower slider frame 21 of which the upper side is opened is supported as an example of a second cleaning frame body at the lower portion of the upper slider frame 17. In FIG. 6, a grid cleaner supporting portion 21*a*, which is formed in the shape of a recess facing the grid electrode 12 provided on the lower side, is formed as an example of a third cleaning-supporting portion at the front end portion of the lower slider frame 21. A grid cleaner 20, which is supported so as to face and come into contact with the grid electrode 12 and cleans the grid electrode 12 according to the reciprocation of the electrode cleaner 16 in the front-and-rear direction, is supported as an example of a third cleaning portion on the lower surface of the grid cleaner supporting portion 21*a*. The grid cleaner 20 of the first example is formed in the shape of a so-called brush that has cleaning bristles fixed to a foundation cloth. However, the grid cleaner 20 is not limited thereto and may be formed to have an arbitrary structure, which can perform cleaning, such as in the shape of a cloth. Meanwhile, since the grid cleaner is described in, for example, JP-A-2006-91456 and the like and may employ various structures well-known in the related art, the detailed description thereof will be omitted.

In FIG. 6, a lower wire cleaner 22, which is disposed so as to face the wire electrode 11, is supported as an example of an electrode cleaning member on the upper surface of the middle portion of the lower slider frame 21 in the front-and-rear direction. As shown in FIG. 6, the lower wire cleaner 22 is disposed at a position separated from the wire electrode 11 when the electrode cleaner 16 is moved to the home position serving as an example of a reference position.

Further, a plate-like portion 21*b* to be detected, which extends downward, is formed on the lower surface of the lower slider frame 21. An optical sensor SN1 is disposed as an example of a detecting member at a position corresponding to the portion 21*b* to be detected when the electrode cleaner 16 is moved to the home position shown in FIG. 6. The optical sensor detects that the electrode cleaner 16 is moved to the home position by detecting the portion 21*b* to be detected.

In FIGS. 5 and 6, a pair of left and right shaft portions 23, which extends inward in a left-and-right direction, is supported on the inner surface of the upper slider frame 17. An upper cleaner support 24 serving as an example of a support for a first cleaning member is disposed between the shaft portions 23. The upper cleaner support 24 includes a pair of left and right rotation center portions 24*a* that is rotatably supported by the shaft portions 23, a pair of left and right arm plate portions 24*b* that extends forward from the rotation center portions as examples of connecting portions, and a plate-like support main body 24*c* that connects the front ends of the arm plate portions 24*b* and extends in the left-and-right direction. An upper wire cleaner 26, which is disposed so as to face the wire electrode 11, is supported as an example of an electrode cleaning member on the lower surface of the support main body 24*c*. Fan-like contacted portions 24*d* for separation, which swell downward, are formed on the lower surfaces of the arm plate portions 24*b*, and can come into contact with a pair of left and right contact portions 27 for separation that extends from the rear end block 3 into the electrode cleaner 16.

Further, torsion springs 28 are mounted on the shaft portions 23 of the first example. The torsion springs 28 serve as examples of pushing members that push the front end of the upper cleaner support 24 in a direction where the front end of the upper cleaner support is rotated downward, that is, a direction where the upper wire cleaner 26 approaches the wire electrode 11.

Figure 7:
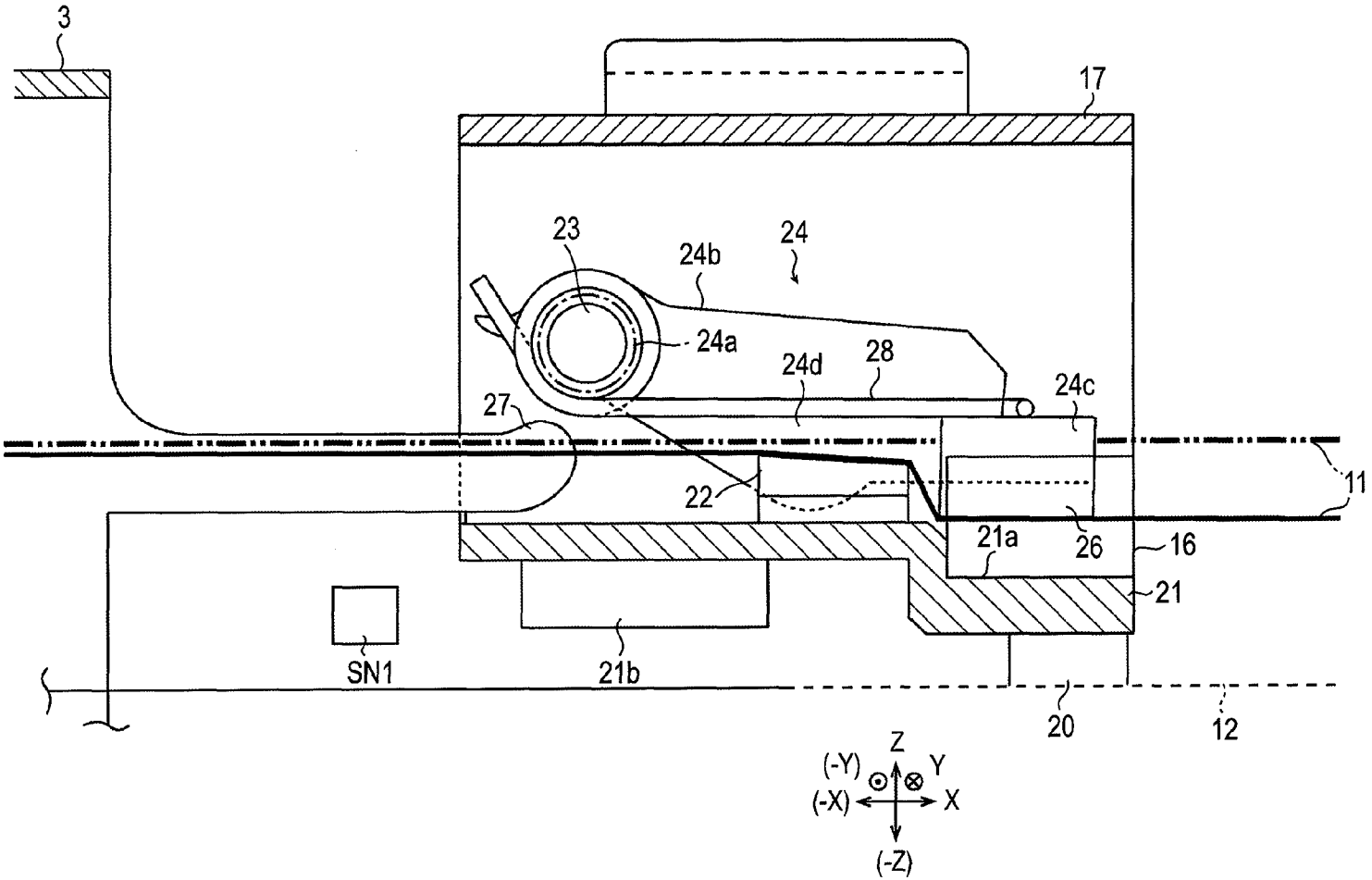
FIG. 7 is a view showing that the electrode cleaner is moved forward from a state shown in FIG. 6.

FIG. 7 is a view showing that the electrode cleaner is moved forward from a state shown in FIG. 6.

Accordingly, the contacted portions 24*d* comes into contact with the contact portions 27 and elastically deform the torsion springs 28 at the reference position shown in FIG. 6, so that the wire electrode 11 and the upper wire cleaner 26 are separated from each other. Further, when the electrode cleaner motor 9 is driven and the electrode cleaner 16 is moved forward, as shown in FIG. 7, the contact between the contacted portion 24*d* and the contact portion 27 is released and the upper wire cleaner 26 presses the wire electrode 11 from above due to the weight of the upper cleaner support 24 or elastic forces of the torsion springs 28. In this case, the wire electrode 11 is pressed down by the upper wire cleaner 26 and is moved to the lower side of the reference position of the wire electrode 11 shown by a two-dot chain line. Accordingly, the lower surface of the wire electrode 11 comes into contact with the lower wire cleaner 22 and the upper and lower wire cleaners 22 and 26 are held at positions shown in FIG. 7, where the upper and lower wire cleaners 22 and 26 come into contact with the wire electrode 11 at a predetermined contact pressure, by the balance between the upper and lower wire cleaners 22 and 26 and the tension of the wire electrode 11. Further, when the electrode cleaner 16 reciprocates in the front-and-rear direction while the wire cleaners 22 and 26 come into contact with the wire electrode 11, the cleaning of the wire electrode 11 is performed.

Meanwhile, since a method of detecting that the electrode cleaner 16 reaches the front end of the charger CCk is well-known in the related art and arbitrary methods, such as methods disclosed in JP-A-2008-26646 ([0037] to [0064] and FIGS. 2 to 4), JP-A-2003-202734 ([0011] to [0018] and FIGS. 1 and 2), JP-A-2003-91145 ([0005] to [0009]), and JP-A-11-242374 ([0016] to [0023]) or methods using sensors, may be employed as the method, the detailed description thereof will be omitted. When the cleaning is completed, the electrode cleaner 16 returns to the home position.

The upper cleaner support 24 or the contacted portions 24*d*, the contact portions 27, the torsion springs 28, and the like form a cleaning contact mechanism 24+27+28 of the first example.

Description of Controller of First Example

Figure 8:
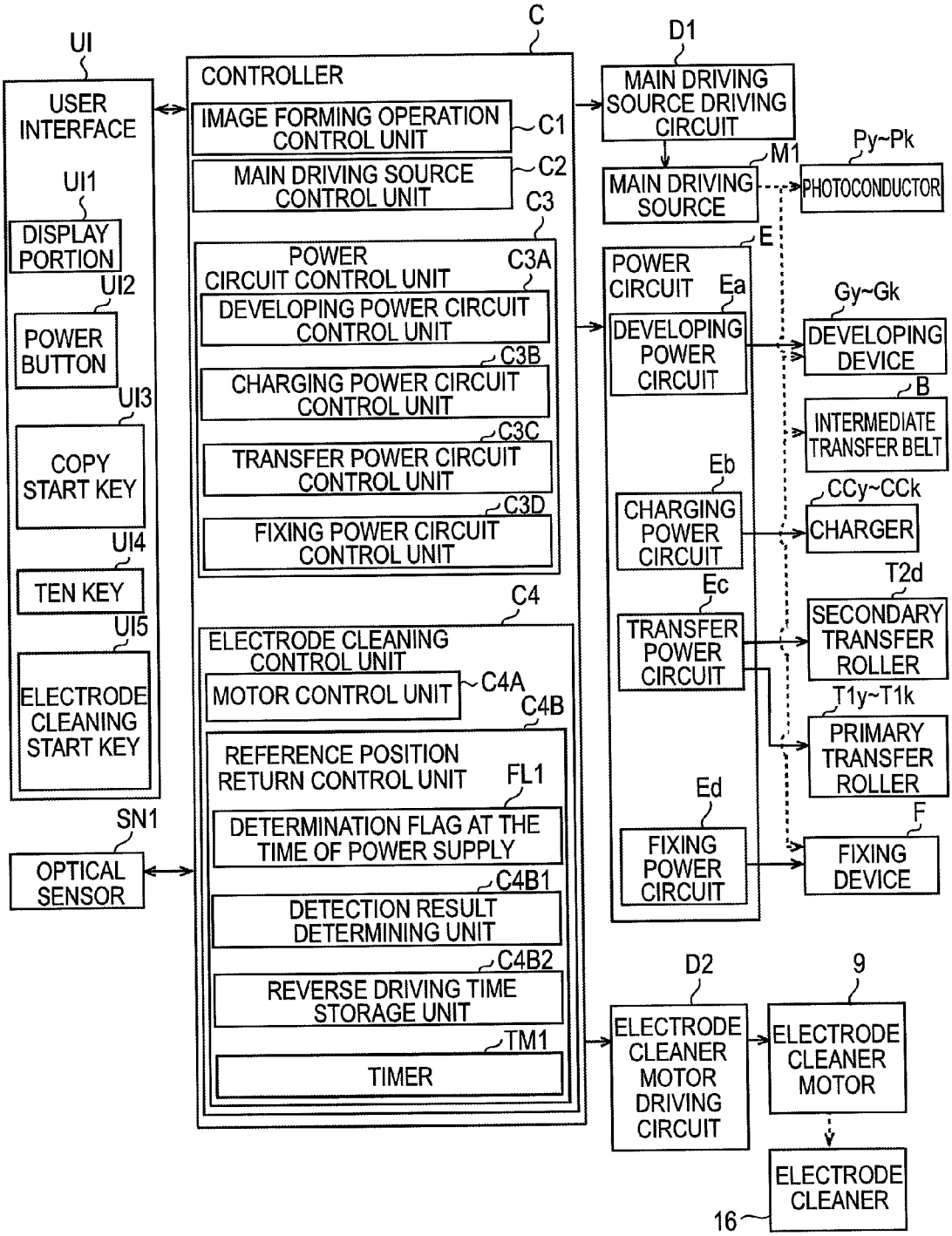
FIG. 8 is a functional diagram, that is, a so-called block diagram of a controller of a printer according to the first example of the invention.

FIG. 8 is a functional diagram, that is, a so-called block diagram of the controller of a printer according to the first example of the invention.

In FIG. 8, the controller C includes an input/output interface I/O that inputs and outputs a signal to or from the outside; a ROM (read-only memory) in which information, programs, and the like used to perform necessary processing are stored; a RAM (random access memory) that temporarily stores necessary data; a CPU (central processing unit) that performs processing corresponding to the program stored in the ROM; and a small information processing unit including an oscillator and the like, that is, a so-called microcomputer. The controller can provide various functions by executing the program stored in the ROM.

(Signal Output Elements Connected to Controller C)

Signals output from signal output elements, such as the user interface UI and the optical sensor SN1, are input to the controller C.

The user interface UI includes a display portion UI1, a power button UI2, ten keys UI4 and a copy start key UI3 serving as examples of input buttons, an electrode cleaning start key UI5 that performs an input to start the electrode cleaning of the chargers CCy to CCk, and the like.

The optical sensor SN1 detects whether the electrode cleaner 16 is moved to the home position.

(Elements, which are to be Controlled, Connected to Controller C)

Further, the controller C is connected to a main driving source driving circuit D1, a power circuit E, an electrode cleaner motor driving circuit D2, and other control elements (not shown); and outputs operation control signals for them.

The main driving source driving circuit D1 rotationally drives the photoconductors Py to Pk, the intermediate transfer belt B, or the like through a main driving source M1.

The power circuit E includes a developing power circuit Ea, a charging power circuit Eb, a transfer power circuit Ec, a fixing power circuit Ed, and the like.

The developing power circuit Ea applies a developing voltage to the developing rollers R0 of the developing devices Gy to Gk.

The charging power circuit Eb applies a charging voltage, which is used to charge the surfaces of the photoconductors Py to Pk, to the respective chargers CCy to CCk.

The transfer power circuit Ec applies a transfer voltage to the primary transfer sections T1*y* to T1*k* or the secondary transfer roller T2*b*.

The fixing power circuit Ed supplies power, which is used to heat a heater, to the heating roller Fh of the fixing device F.

The electrode cleaner motor driving circuit D2 drives the electrode cleaner 16 through the electrode cleaner motor 9.

(Functions of Controller C)

The controller C has a function of performing processing corresponding to signals that are input from the signal output elements, and a function of outputting control signals to the respective control elements. That is, the controller C has the following functions.

C1: Image Forming Operation Control Unit

An image forming operation control unit C1 performs a job as an example of an image forming operation by controlling the driving of each member of the image forming apparatus U, the application time of each voltage, or the like according to image information that is input from the image input device U1.

C2: Main Driving Source Control Unit

A main driving source control unit C2 controls the driving of the photoconductors Py to Pk and the like by controlling the driving of the main driving source M1 through the main driving source driving circuit D1.

C3: Power Circuit Control Unit

A power circuit control unit C3 includes a developing power circuit control unit C3A, a charging power circuit control unit C3B, a transfer power circuit control unit C3C, and a fixing power circuit control unit C3D. The power circuit control unit C3 controls the application of a voltage to each unit or the supply of power to each member by controlling the operation of the power circuit E.

C3A: Developing Power Circuit Control Unit

The developing power circuit control unit C3A controls a developing voltage, which is applied to the developing rollers of the developing devices Gy to Gk, by controlling the developing power circuit Ea.

C3B: Charging Power Circuit Control Unit

The charging power circuit control unit C3B controls a charging voltage, which is applied to the chargers CCy to CCk, by controlling the charging power circuit Eb.

C3C: Transfer Power Circuit Control Unit

The transfer power circuit control unit C3C controls a primary transfer voltage, which is applied to the primary transfer sections T1*y* to T1*k*, or a secondary transfer voltage, which is applied to the secondary transfer roller T2*b*, by controlling the transfer power circuit Ec.

C3D: Fixing Power Circuit Control Unit

The fixing power circuit control unit C3D controls the temperature of a heater of the heating roller Fh of the fixing device F, that is, fixing temperature by controlling the fixing power circuit Ed.

C4: Electrode Cleaning Control Unit

An electrode cleaning control unit C4, which serves as an example of a movement control unit for the electrode cleaner 16, includes a motor control unit C4A and a reference position return control unit C4B. The electrode cleaning control unit C4 controls the cleaning of the electrodes 11 and 12 of the chargers CCy to CCk by controlling the electrode cleaner 16. When the input of the electrode cleaning start key UI5 is performed, whenever the accumulated number of printed sheets as an example of a predetermined number of sheets is 1000, or when power is supplied to the image forming apparatus U, that is, when the power button UI2 is turned on, the electrode cleaning control unit C4 of the first example controls the electrode cleaner to clean the electrodes 11 and 12. Further, when the input of the electrode cleaning start key UI5 is performed or when 1000 sheets have been printed, the electrode cleaning control unit C4 of the first example performs cleaning by reciprocating the electrode cleaner 16 in the front-and-rear direction at predetermined times. When power is supplied to the image forming apparatus, the electrode cleaning control unit performs a control to make the electrode cleaner 16 return to the reference position by the reference position return control unit C4B.

C4A: Motor Control Unit

The motor control unit C4A controls the movement of the electrode cleaner 16 by controlling the driving of the electrode cleaner motor 9 in the normal and reverse directions through the electrode cleaner motor driving circuit D2.

C4B: Reference Position Return Control Unit

The reference position return control unit C4B includes a determination flag FL1 at the time of power supply, a detection result determining unit C4B1, a reverse driving time storage unit C4B2, and a timer TM1. When the chargers CCy to CCk are mounted on the image recording device U3, the reference position return control unit C4B moves the electrode cleaner 16 in a direction where the electrode cleaner is separated from the home position (reference position). When the optical sensor SN1 cannot detect the portion 21*b* to be detected, the reference position return control unit C4B moves the electrode cleaner 16 toward the home position and moves the electrode cleaner 16 to the home position. The reference position return control unit C4B of the first example performs a series of operations that make the electrode cleaner return to the home position at the time of power supply as a case where there is a possibility that the chargers CCy to CCk have been attached or detached.

FL1: Determination Flag FL1 at the Time of Power Supply

The determination flag FL1 at the time of power supply as an example of an attachment/detachment determination unit is "0" at the beginning and becomes "1" after power supply. That is, when power is reduced, the determination flag FL1 at the time of power supply is initialized and becomes "0".

C4B1: Detection Result Determining Unit

The detection result determining unit C4B1 determines whether the portion 21*b* to be detected exists at the position of the optical sensor SN1, that is, whether the electrode cleaner 16 is moving forward from the reference position on the basis of the detection signal of the optical sensor SN1.

C4B2: Reverse Driving Time Storage Unit

The reverse driving time storage unit C4B2 stores a reverse driving time t1 that is a time until the motor 9 is stopped after being driven in a reverse direction in order to move the electrode cleaner 16 toward the home position.

TM1: Timer

The timer TM1 determines whether the reverse driving time t1 has passed.

Description of Flowchart of First Example

Next, the control flow of the printer U according to the first example will be described using a flowchart.

(Description of Flowchart of Reference Position Return Processing of Electrode Cleaner)

Figure 9:
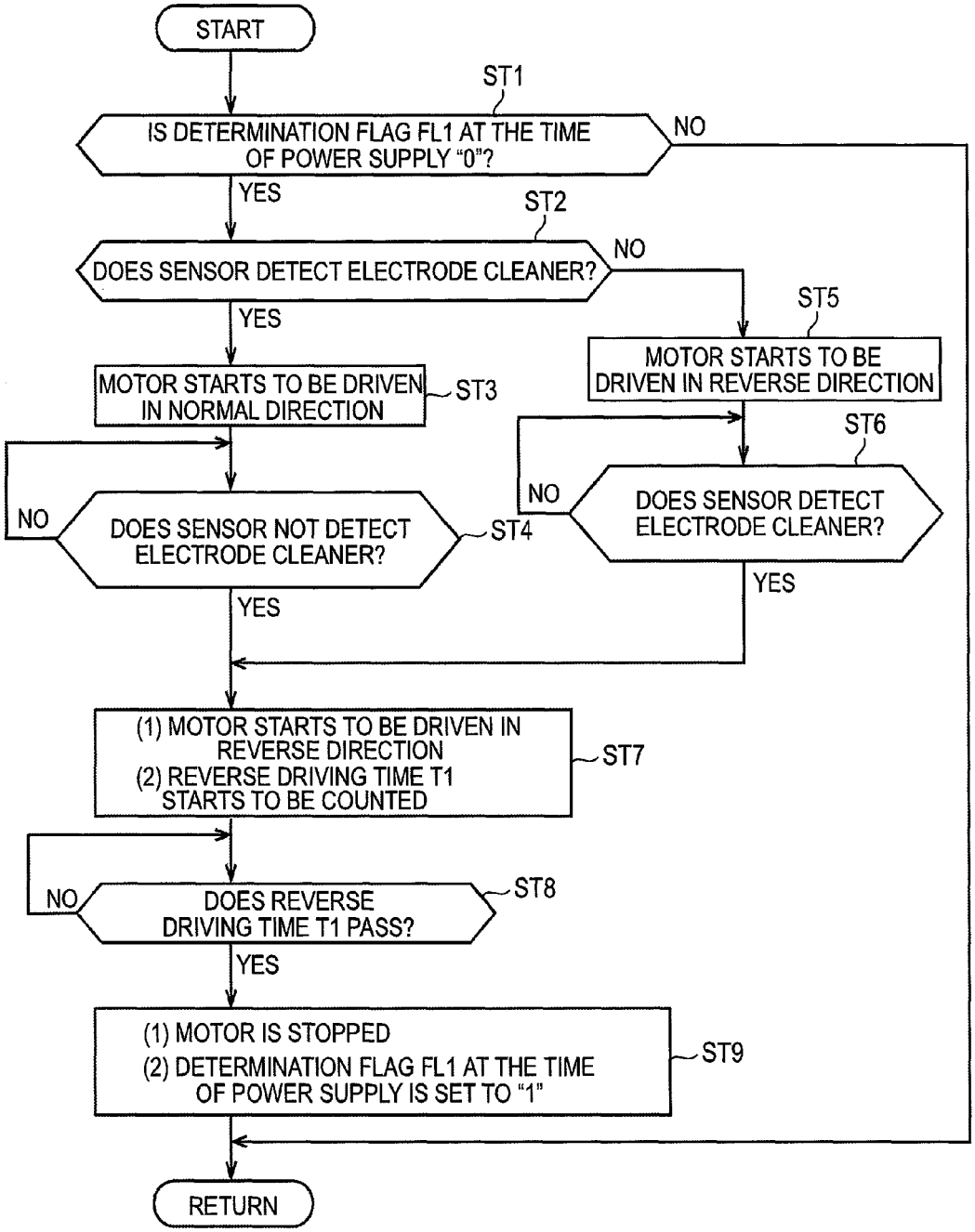
FIG. 9 is a flowchart of reference position return processing of the electrode cleaner of the first example.

FIG. 9 is a flowchart of reference position return processing of the electrode cleaner of the first example.

The processing of each step ST of the flowchart of FIG. 9 is performed according to the program stored in the controller C of the printer U. Further, this processing and other various kinds of processing of the printer U are performed in parallel.

The flowchart shown in FIG. 9 is started by the supply of power to the printer U.

In Step ST1 of FIG. 9, it is determined whether the determination flag FL1 at the time of power supply is "0". If the determination flag FL1 at the time of power supply is "0" (Yes), a process proceeds to Step ST2. If the determination flag FL1 at the time of power supply is not "0" (No), the process returns to Step ST1.

In Step ST2, it is determined whether the optical sensor SN1 detects the portion 21*b* to be detected of the electrode cleaner 16. If the optical sensor SN1 detects the portion 21*b* to be detected of the electrode cleaner 16 (Yes), the process proceeds to Step ST3. If the optical sensor SN1 does not detect the portion 21*b* to be detected of the electrode cleaner 16 (No), the process proceeds to Step ST5.

In Step ST3, the motor 9 starts to be driven in the normal direction, that is, the electrode cleaner 16 starts to move forward. Then, the process proceeds to Step ST4.

In Step ST4, it is determined whether the optical sensor SN1 detects the portion 21*b* to be detected of the electrode cleaner 16, that is, it is determined whether the position of the electrode cleaner 16 is largely deviated from the home position at the time of power supply. If the optical sensor SN1 detects the portion 21*b* to be detected of the electrode cleaner 16 (Yes), the process proceeds to Step ST7. If the optical sensor SN1 does not detect the portion 21*b* to be detected of the electrode cleaner 16 (No), Step ST4 is repeated.

In Step ST5, the motor 9 starts to be driven in the reverse direction, that is, the electrode cleaner 16 starts to move toward the rear home position. Then, the process proceeds to Step ST6.

In Step ST6, it is determined whether the optical sensor SN1 detects the portion 21*b* to be detected of the electrode cleaner 16. If the optical sensor SN1 detects the portion 21*b* to be detected of the electrode cleaner 16 (Yes), the process proceeds to Step ST7. If the optical sensor SN1 does not detect the portion 21*b* to be detected of the electrode cleaner 16 (No), Step ST6 is repeated.

The following processes (1) and (2) is performed in Step ST7, and the process proceeds to Step ST8.

(1) The motor 9 starts to be driven in the reverse direction. Meanwhile, if the motor is being driven in the reverse direction, the motor continues to be driven in the reverse direction.

(2) The reverse driving time t1 starts to be counted.

In Step ST8, it is determined whether the reverse driving time t1 has passed. If the reverse driving time t1 has passed (Yes), the process proceeds to Step ST9. If the reverse driving time t1 has not passed (No), Step ST8 is repeated.

The following processes (1) and (2) are performed in Step ST9, and the process returns to Step ST1.

(1) The motor 9 is stopped.

(2) The determination flag FL1 at the time of power supply is set to "1".

Operation of First Example

When a voltage is applied to the wire electrode 11 and the electrode member 2+12 facing the wire electrode and a potential difference is generated in the image forming apparatus U according to the first example of the invention having the above-mentioned structure, discharge is generated and the surfaces of the photoconductors Py to Pk are charged. In the first example, charges are uniformly supplied to the photoconductors Py to Pk by the grid electrode 12 and the photoconductors are uniformly charged.

Discharge products, such as ozone $O_3$ or nitrogen oxide $NO_x$, are generated in the chargers CCy to CCk at the time of the discharge of chargers CCy to CCk. These discharge products are attached to the shield electrode 2 or the grid electrode 12. The discharge products are blown away by air sent from an air blower, and a part of the discharge products is discharged together with the air.

When the input of the electrode cleaning start key UI5 is performed or whenever the accumulated number of printed sheets is 1000, the electrode cleaner 16 reciprocates in the front-and-rear direction in the image forming apparatus U according to the first example, so that the discharge products attached to the wire electrode 11 and the grid electrode 12 are removed.

Figure 10:
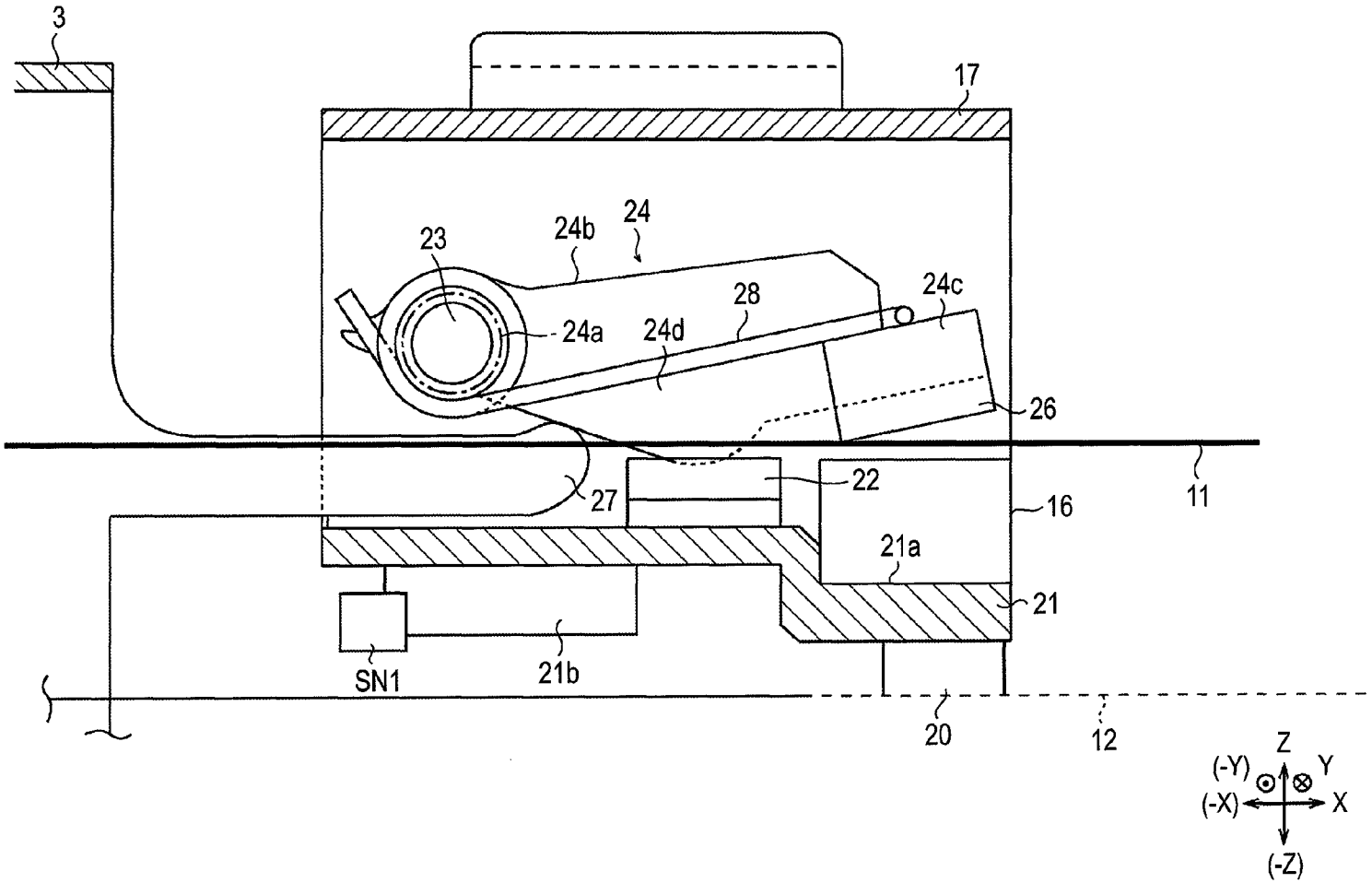
FIG. 10 is a view showing the electrode cleaner of the first example, and is a view showing that the electrode cleaner is slightly deviated forward from a home position.

FIG. 10 is a view showing the electrode cleaner of the first example, and is a view showing that the electrode cleaner is slightly deviated forward from the home position.

If the chargers CCy to CCk break down or the life of the chargers comes to an end, the chargers may be checked after being detached or may be replaced. In this case, when the chargers CCy to CCk are detached or while new chargers CCy to CCk are conveyed before being mounted, driven couplings 7 may be rotated. When the driven coupling 7 is rotated, the electrode cleaner 16 is moved forward from the home position. In this case, if the electrode cleaner is moved forward until the optical sensor SN1 cannot detect the portion 21*b* to be detected, the optical sensor SN1 can detect that the electrode cleaner 16 is deviated from the home position. However, there is a concern that the electrode cleaner will be moved from the home position and the optical sensor SN1 will not be able to detect the portion 21*b* to be detected due to the deterioration of the mounting accuracy of the optical sensor SN1, the deterioration of the component accuracy and the mounting accuracy of the portion 21*b* to be detected, the backlash of the electrode cleaner 16 at the time of the movement of the electrode cleaner, and the like. In this state, there is a concern that the electrode cleaner 16 will reach the end portion of the charge area Q1 in a width direction and a partial charging failure will occur.

In particular, when the electrode cleaner is moved from the home position, there is also a concern that the optical sensor SN1 will not be able to detect the portion 21*b* to be detected and any one or all of the respective cleaners 20, 22, and 26 will come into contact with the electrodes 11 and 12 as shown in FIG. 10. In particular, there is a concern that electrical resistance will change when the cleaners 22 and 26 come into contact with the wire electrode 11. For this reason, there is a concern that discharge performance will be changed relative to predetermined performance. Accordingly, if a charging operation starts when the optical sensor SN1 cannot detect the portion 21*b* to be detected and the electrode cleaner does not return to the home position, a charging failure occurs. For this reason, there is a concern that an image forming failure will occur.

In contrast, after the electrode cleaner 16 is moved forward until the optical sensor SN1 cannot detect the portion 21*b* to be detected at the time of power supply where there is a possibility that the chargers CCy to CCk have been attached or detached, the electrode cleaner 16 is moved toward the rear home position and reliably returns to the home position.

Accordingly, the occurrence of a charging failure or an image forming failure is decreased as compared to the techniques disclosed in JP-A-2008-26646 ([0037] to [0064] and FIGS. 2 to 4), JP-A-2003-202734 ([0011] to [0018] and FIGS. 1 and 2), JP-A-2003-91145 ([0005] to [0009]), and JP-A-11-242374 ([0016] to [0023]). Further, since a motor is supported by a charger in the technique disclosed in JP-A-2008-26646 ([0037] to [0064] and FIGS. 2 to 4), weight is increased. For this reason, there are also problems in that a workload on the replacement of the charger is increased and the cost of the charger itself, which is a unit to be replaced, is increased. However, since the motor 9 is provided in the image recording device U3 in the first example, these problems are addressed.

Furthermore, it is considered that the electrode cleaner is moved backward from the beginning regardless of the detection result of the optical sensor SN1. However, if the electrode cleaner 16 having been moved to the home position is moved backward, a load is applied to the motor 9. For this reason, there is a concern that a problem such as the breakdown of the motor or the distortion of the charger main body 1 will be caused. In contrast to this, the electrode cleaner is moved backward after being moved forward once in the chargers CCy to CCk of the first example. Accordingly, the occurrence of a problem such as the breakdown of the motor 9 or the distortion of the charger main body 1 is suppressed.

(Modifications)

The example of the invention has been described in detail above, but the invention is not limited thereto. The various modifications of the invention can be made within the scope of the invention set forth in the claims. Modifications (H01) to (H08) of the invention will be exemplified below.

(H01) The invention is not limited to a copying machine as an example of an image forming apparatus in the above-mentioned example, and may also be applied to image forming apparatuses such as a printer and a facsimile. Further, the invention is not limited to a color image forming apparatus, and may also be applied to a monochrome image forming apparatus. Furthermore, the invention is not limited to a tandem type image forming apparatus, and may also be applied to a rotary type image forming apparatus.

(H02) A case where the wire electrode 11 is one wire rod has been exemplified in the above-mentioned example, but the invention is not limited thereto. The wire electrode may include two wire rods.

(H03) The grid electrode 12 may be omitted in the above-mentioned example.

(H04) The configuration where the cleaners 22 and 26 come into contact with and are separated from the wire electrode has been exemplified in the above-mentioned example. However, the configuration where the cleaners 22 and 26 always come into contact with the wire electrode 11 may be employed.

(H05) The charger serving as an example of a discharger has been exemplified in the above-mentioned example, but the invention is not limited thereto. The transfer sections T1*y* to T1*k* and T2, an auxiliary charger or a static eliminator for a recording sheet S, the photoconductors Py to Pk as other examples of a discharger, or the like may be used.

(H06) The structure that moves the electrode cleaner 16 in the front-and-rear direction in the above-mentioned example is not limited to the structure that uses the exemplified shaft 6. An arbitrary structure that can move in the front-and-rear direction may be employed as the structure that moves the electrode cleaner in the front-and-rear direction.

(H07) The positions where the portion 21*b* to be detected and the optical sensor SN1 are disposed are not limited to the positions that are exemplified in the above-mentioned example, and may be changed to arbitrary positions that are deviated in the front-and-rear direction or the left-and-right direction. In addition, for example, the portion 21*b* to be detected may protrude to the outside of the charger main body 1, and the optical sensor SN1 may not be disposed in the unit of each of the chargers CCy to CCk and may be disposed on each of the photoconductors Py to Pk or the main body U3 of the image forming apparatus so as to perform detection.

(H08) The structure of the electrode cleaning member 20 is not limited to the structure exemplified in the above-mentioned example, and an arbitrary structure may be employed according to design or the like. For example, the structure, such as the brush or the cloth, may be changed to an arbitrary structure, which can perform cleaning, for example, a sponge or the like. Further, a cleaning portion, which comes into contact with the inner peripheral surface of the shield electrode 2, may be provided, so that the shield electrode 2 can be cleaned. Alternatively, a cleaning member, which comes into contact with the lower surface of the grid electrode 12, may be provided so that both surfaces of the grid electrode 12 can be cleaned.

The foregoing description of the exemplary embodiments of the invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention is defined by the following claims and their equivalents.

What is claimed is:

1. A discharger comprising:

a discharger main body that is disposed so as to face a discharged portion of an image forming apparatus and is adapted to be attached to and detached from a holding member of the image forming apparatus body;

a first electrode member that is supported by the discharger main body and is formed of a wire rod;

an electrode cleaning member that contacts with and cleans the first electrode member;

a detected portion that is integrally disposed to the electrode cleaning member;

a detecting member that detects the detected portion while the electrode cleaning member is in a predetermined reference position;

a cleaning member conveyer that conveys the electrode cleaning member along the first electrode member in both directions which toward and away from the reference position; and a movement control unit that controls a movement of the cleaning member conveyer by the conveyer, wherein the movement control unit controls the conveyer to move the electrode cleaning member away from the reference position when the discharger main body is mounted on the holding member until the detecting member does not detect the detected portion, and then after moving the electrode cleaning member away from the reference position in a front-and-rear direction, said movement control unit controls the conveyer to move the electrode cleaning member toward the reference position.

2. The discharger according to claim 1, further comprising:

a cleaner contacting mechanism that detaches the electrode cleaning member from the first electrode member when the electrode cleaning member is located at the reference position, and makes the electrode cleaning member contact with the first electrode member while the electrode cleaning member is conveyed from the reference position in the front-and-rear direction.

3. The discharger according to claim 1, further comprising:

a second electrode member that is disposed between the first electrode member and the discharged portion, a voltage for discharge being applied between the first and second electrode members; wherein the electrode cleaning member is disposed so as to contact with the second electrode member and cleans the second electrode member.

4. The discharger according claim 1, wherein the cleaning member conveyer includes an engaging member which detachably engaging with a transmission member of the image forming apparatus, the transmission member transmitting a driving source when the discharger main body is attached to the holding member, and the cleaning member conveyer conveys the electrode cleaning member toward the reference position when the engaging member is rotated in a first rotating direction, and conveys the electrode cleaning member away from the reference position when the engaging member is rotated in a second rotating direction.

5. An image forming apparatus comprising:

a main body of an image forming apparatus that includes an image recording unit;

a holding member; and the discharger according to claim 1 that is detachably mounted on the holding member.

6. The discharger according to claim 1, wherein the reference position is a position where the electrode cleaning member is disposed away from the first electrode, and the movement control unit moves the cleaning member away from the reference position to a forward position.

7. The discharger according to claim 6, wherein the forward position is a position where the detecting member cannot detect the detecting portion.

8. The discharger according to claim 7, wherein the electrode cleaning member is returned back to the reference position after being in the forward position.

* * * * *